US005711363A

United States Patent [19]

Scruggs et al.

[11] Patent Number: 5,711,363

[45] Date of Patent: Jan. 27, 1998

[54] DIE CASTING OF BULK-SOLIDIFYING AMORPHOUS ALLOYS

[75] Inventors: David M. Scruggs, Oceanside; William L. Johnson; Atakan Peker, both of Pasadena, all of Calif.

[73] Assignee: Amorphous Technologies International, Laguna Niguel, Calif.

[21] Appl. No.: 602,899

[22] Filed: Feb. 16, 1996

[51] Int. Cl.[6] ..... B22D 17/04

[52] U.S. Cl. ..... 164/113; 164/312

[58] Field of Search ..... 164/113, 312; 148/561

[56] References Cited

U.S. PATENT DOCUMENTS

| | | | |
|---|---|---|---|
| 5,296,059 | 3/1994 | Masumoto et al. . | |
| 5,306,463 | 4/1994 | Horimura . | |
| 5,312,495 | 5/1994 | Masumoto et al. . | |
| 5,324,368 | 6/1994 | Masumoto et al. . | |
| 5,589,012 | 12/1996 | Hobby et al. | 148/561 |

OTHER PUBLICATIONS

A. Kato et al., "Production of Bulk Amorphous $Mg_{85}Y_{10}Cu_5$ Alloy by Extrusion of Atomized Amorphous Powder," *Materials. Trans., JIM*, vol. 35, No. 2 (1994), pp. 125–129.

Y. Kawamura et al., "Full strength compacts by extrusion of glass metal powder at the supercooled liquid state," *Appl. Phys. Lett.*, vol. 67 (14) (1995), pp. 2008–2010.

American Society for Metals, "Metals Handbook, vol. 6, Forging and Casting", article on Die Casting, pp. 285–306 (1970).

A. Inoue et al., "Mg–Cu–Y Bulk Amorphous Alloys with High Tensile Strength Produced by a High–Pressure Die Casting Method", *Materials Transactions, JIM*, vol. 33, No. 10, pp. 937–945 (1992).

A. Inoue et al., "Bulky La–A1–TM (TM=Transition Metal) Amorphous Alloys with High Tensile Strength Produced by a High–Pressure Die Casting Metod," *Materials Transactions, JIM*, vol. 34, No. 4, pp. 351–358 (1993).

K. Amiya et al., "Mechanical strength and thermal stability of Ti–based amorphous alloys with large glass–forming ability," *Materials Science and Engineering*, A179/A180, pp. 692–696 (1994).

Interbike Buyer Official Show Guide, p. 171 (1995).

*Primary Examiner*—Kuang Y. Lin

*Attorney, Agent, or Firm*—Gregory Garmong

[57] ABSTRACT

Solid die-cast articles are prepared from a charge of a bulk-solidifying amorphous alloy. The charge is heated to an injection temperature and injected into a die-casting mold. The charge is cooled at a rate, about 500° C. per second or less, such that its amorphous structure is retained in the solidified article.

16 Claims, 5 Drawing Sheets

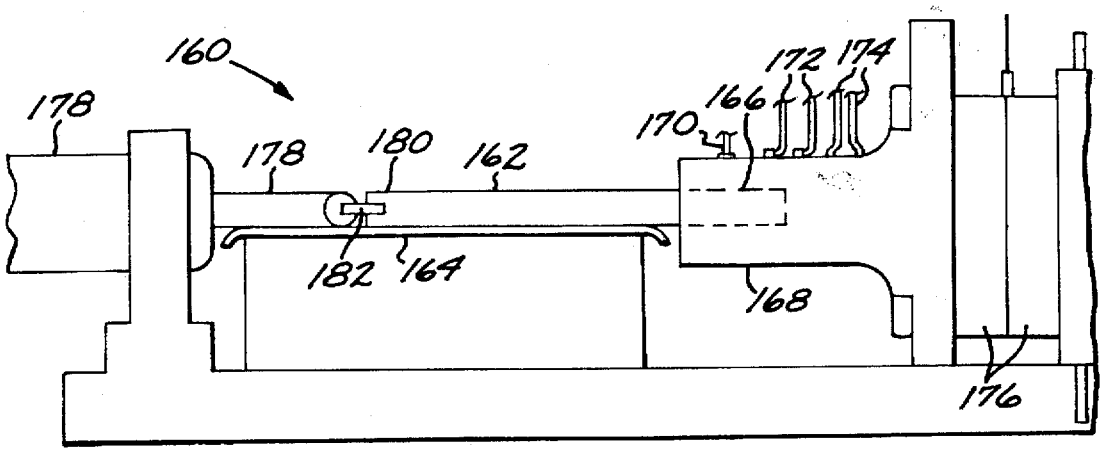
FIG. 8
FIG. 9
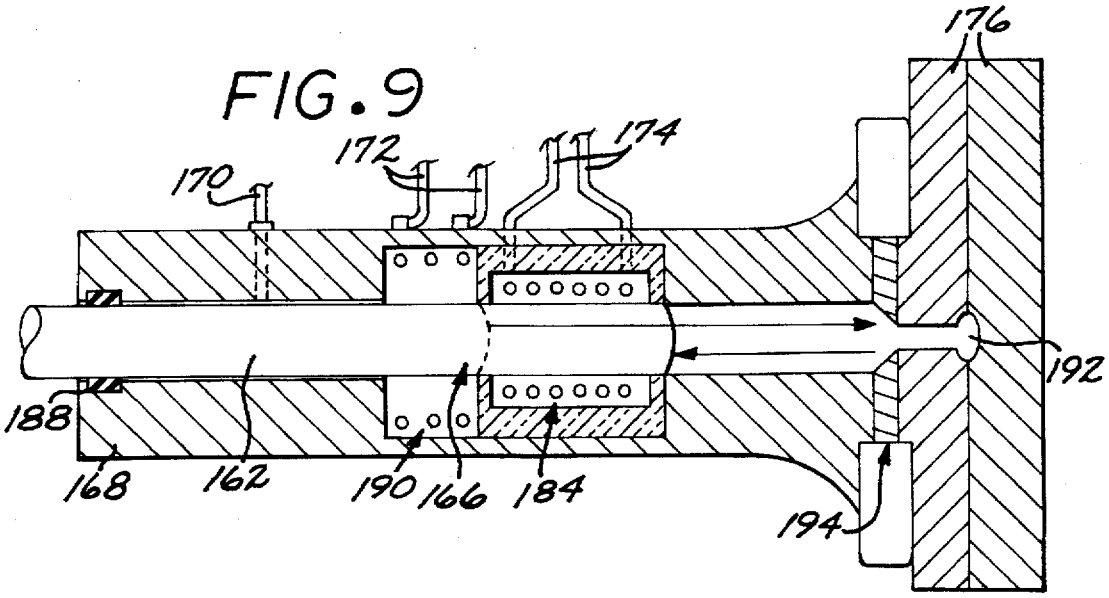
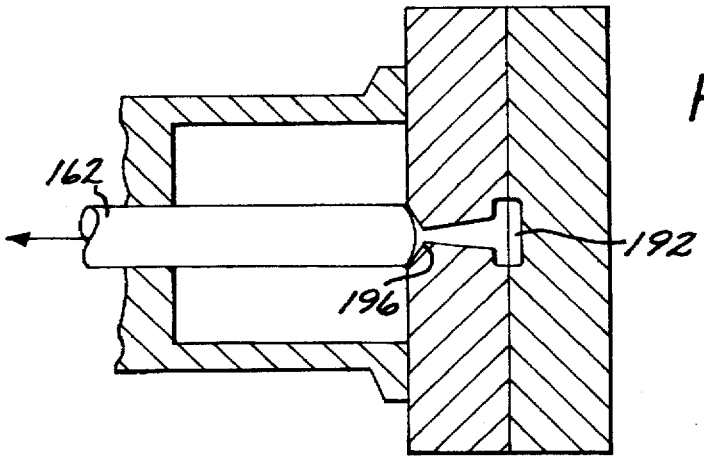
FIG. 10

DIE CASTING OF BULK-SOLIDIFYING AMORPHOUS ALLOYS

BACKGROUND OF THE INVENTION

This invention relates to amorphous alloys, and, more particularly, to the die casting of such alloys.

A large portion of the metallic alloys in use today are processed by solidification casting, at least initially. The metallic alloy is melted and cast into a metal or ceramic mold, where it solidifies. The mold is stripped away, and the cast metallic piece is ready for use or for further processing.

Commercial-scale metallic mold casting technologies are divided into two principal groups, permanent mold casting and die casting. In permanent mold casting, the molten metal is fed to the mold under the force of gravity or a relatively small metal pressure head. Common types of permanent mold casting include ingot casting, continuous casting, semi-continuous casting, and ribbon casting. The present invention deals with die casting.

In die casting, the molten metal is supplied to the die-casting mold under a relatively high pressure, typically 500 psi (pounds per square inch) or more, such as a piston pressure. The molten metal is forced into the shape defined by the interior surface of the mold. The shape can usually be more complex than easily attained using permanent mold casting, because the metal is forced into complexly shaped features of the die-casting mold such as deep recesses. The die casting mold is usually a split-mold design, so that the mold halves can be separated to expose the solidified article and facilitate the extraction of the solidified article from the mold.

High-speed die-casting machines have been developed to reduce production costs, with the result that many of the small cast metallic parts found in consumer and industrial goods are produced by die casting. In such die-casting machines, a charge or "shot" of molten metal is heated above its melting point and forced into the closed die under a piston pressure of at least several thousand pounds per square inch. The metal quickly solidifies, the die halves are opened, and the part is ejected. Commercial machines may employ multiple die sets, so that additional parts can be cast while the previously cast parts are cooling and being removed from the die, and the die is prepared with a lubricant coating for its next use.

When the metal is forced into the die-casting mold in commercial die-casting machinery, it first solidifies against the opposing mold walls. There are often defects such as porosity at the surface of the die-cast article. Also, there is a tendency to form a shrinkage cavity or porosity along the centerline of the die-casting mold. Processing techniques have been developed to force additional molten metal into the shrinkage cavity so as to improve the soundness of the casting. However, on the whole, conventional die casting produces somewhat porous parts of relatively low soundness and therefore relatively poor mechanical properties. Die-cast parts are not usually considered for applications requiring high mechanical strengths and performance.

There is needed an improved approach to the casting of metals which permits the rapid production, by die-casting techniques, of sound, high-quality parts. The present invention fulfills this need, and further provides related advantages.

SUMMARY OF THE INVENTION

The present invention provides an improved approach to die casting metal articles. The articles can be die cast at the high production rates possible with this technology, with a further increase in the production rate because die lubrication can be omitted in many cases. The articles are of better metallurgical soundness, quality, and strength properties than achieved in conventional die-cast parts. Die-cast parts can therefore be considered for applications not heretofore possible because of strength limitations.

In accordance with the invention, a method for preparing solid die-cast articles includes providing a charge of a bulk-solidifying amorphous alloy. The present invention extends to several types of bulk-solidifying amorphous alloys, which classes overlap to some extent: bulk-solidifying amorphous alloy having a linear coefficient of expansion of no greater than about $10\times10^{-6}$ per °C. when measured at a temperature below $T_g$, where $T_g$ is the temperature corresponding to a viscosity of the bulk-solidifying amorphous alloy of about $10^{13}$ poise; bulk-solidifying amorphous alloys that are die cast at a temperature such that their viscosity is greater than about $10^8$ poise but less than about $10^{15}$ poise; and bulk-solidifying amorphous alloys having a titanium+zirconium content of at least about 20 atomic percent of the alloy. The method further includes heating the charge of the bulk-solidifying amorphous alloy to an injection temperature, injecting the charge of heated bulk-solidifying amorphous alloy into a die-casting mold under pressure, and cooling the charge in the die-casting mold at a cooling rate such that the charge remains amorphous in structure. The present invention can be practiced with conventional die-casting machinery, or with die-casting apparatus specially designed for use with these bulk-solidifying amorphous casting materials. The approach is preferably practiced using an apparatus including a die-casting mold having a metal injection port leading to a die mold cavity with an internal molding surface, a metal injector disposed to force metal into the injection port, and a metal heater operable to heat a charge of metal and provide the heated charge to the metal injector.

Bulk-solidifying amorphous alloys are a. recently developed class of amorphous alloys that can retain their amorphous structures when cooled at rates of about 500° C. per second or less, depending upon the alloy composition. Bulk-solidifying amorphous alloys have been described, for example, in U.S. Pat. Nos. 5,288,344 and 5,368,659, whose disclosures are incorporated by reference.

Bulk-solidifying amorphous alloys have several properties that make their use in die casting particularly advantageous. They are often found adjacent to deep eutectic compositions, so that the temperatures involved in the die-casting operation are relatively low.

Additionally, upon cooling from high temperature, such alloys do not undergo a liquid-solid transformation in the conventional sense of alloy solidification. Instead, the bulk-solidifying amorphous alloys become more and more viscous with decreasing temperature, until their viscosity is so high that, for most purposes, they behave as solids (although they are usually described as undercooled liquids). Because the bulk-solidifying amorphous alloys do not undergo a liquid-solid transformation, they do not experience a sudden, discontinuous volume change at a solidification temperature. It is this volume change that leads to most of the centerline shrinkage and porosity in die-cast articles made of conventional alloys. As a result of its absence in bulk-solidifying amorphous alloys, the die-cast articles produced with this material are of higher metallurgical soundness and quality than conventional die-cast articles.

Bulk-solidifying amorphous alloys are characterized by a low coefficient of friction at their surfaces. Consequently, there is little or no need for a lubricant between the molten metal and the internal molding surface of the die-casting mold. The step of coating the molding surface with a lubricant between each die-casting operation, which is a necessary part of most prior die-casting operations, is eliminated for most applications. In some cases, the presence of the lubricant can adversely affect the surface finish of the die-cast article, and its elimination in one embodiment of the present invention therefore offers the advantage of improved surface finish in the final article.

Lastly, bulk-solidifying amorphous alloys have excellent mechanical and physical properties. They exhibit good strength. They have good corrosion resistance as a result of the absence of grain boundaries. The absence of grain boundaries also leads to an excellent surface finish. By making the internal molding surface very smooth, the surface finish and appearance of the die-cast article made of the bulk-solidifying amorphous alloy can be quite good.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 8 is a schematic elevational view of a die casting apparatus for die casting from solid ingots;

FIG. 9 is a schematic sectional view of one embodiment of the apparatus of FIG. 8; and FIG. 10 is schematic sectional view of a second embodiment of the apparatus of FIG. 8.

DETAILED DESCRIPTION OF THE INVENTION

Figure 1:
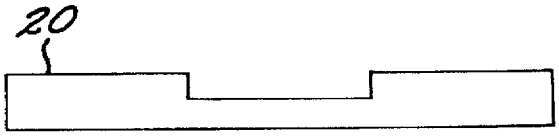
FIG. 1 is a die-cast article prepared in accordance with the invention.

FIG. 1 depicts a die-cast article 20 made of a bulk-solidifying amorphous alloy. This article 20 is presented in a general form, inasmuch as the article may have a wide range of shapes and sizes.

Figure 2:
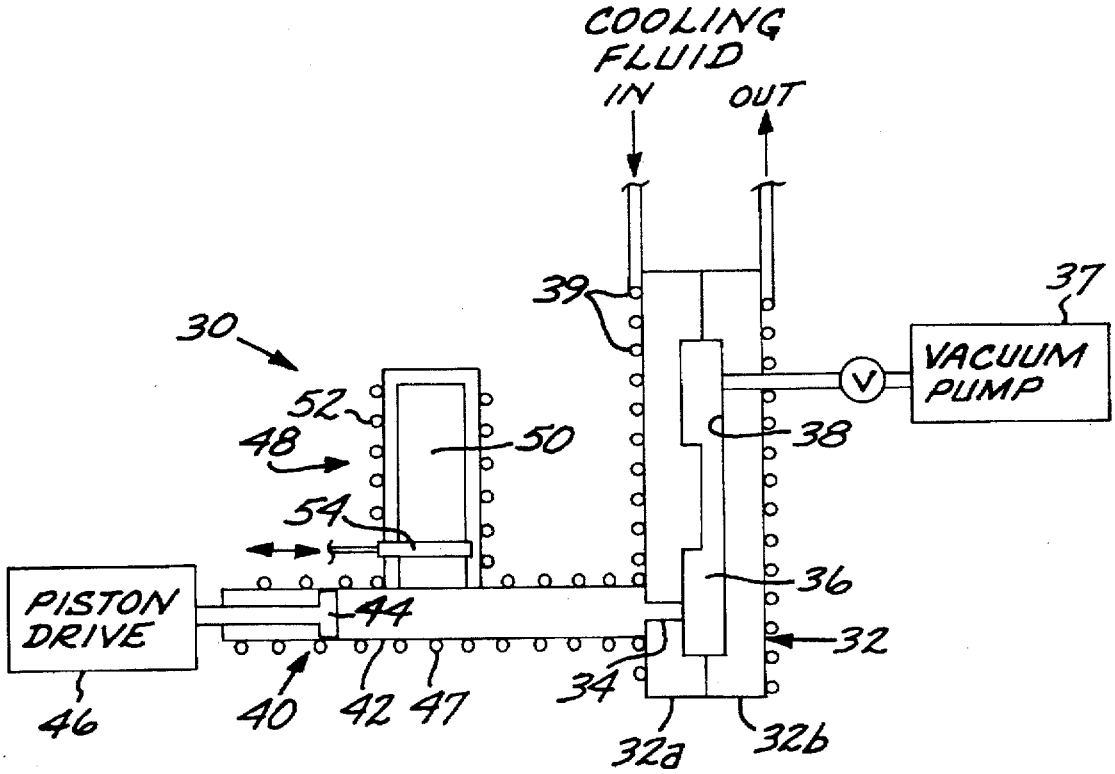
FIG. 2 is a schematic view of an apparatus used to prepare the article of FIG. 1.

A die-casting apparatus 30 used to prepare the article 20 is depicted in FIG. 2. The apparatus 30 includes a die-casting mold 32, which is preferably in a split form having mold segments 32*a* and 32*b*. The mold segments 32*a* and 32*b* are controllably positioned in closely facing relationship, as illustrated, to permit filling of the mold, or spread apart to permit removal of the die-cast article from the mold upon completion of the die-casting cycle. One of the mold segments, here the mold segment 32*a*, is typically fixed and the other mold segment, here the mold segment 32*b*, is movable. Suitable reciprocating apparatus (not shown) for moving the mold segment 32*b* is provided. The die-casting mold 32 includes a metal injection port 34 that leads to a die-casting cavity 36 inside the mold 32. The die-casting cavity 36 may be controllably evacuated by a vacuum pump 37 acting through a controllable vacuum valve. The die-casting cavity has an internal molding surface 38 whose shape defines the shape of the article 20 during the die-casting operation. Optionally, cooling channels 39 are provided in contact with the die-casting mold 32 to controllably cool it with a flow of a coolant such as water or ethylene glycol.

For reasons to be discussed subsequently, it is often desirable that the internal molding surface 38 be very smooth and of a fine surface finish with a surface roughness of less than about 3 microinches RMS. A smooth internal molding surface 38 can be achieved by careful mechanical and/or chemical polishing of the internal molding surface 38. It is preferred that the die-casting mold 32, and especially the portion of the mold that forms the internal molding surface 38, be made of a steel that is highly resistant to heat checking, such as H-11 or H-13 tool steels or a maraging steel. The internal molding surface 38 can also be made of, or coated with, an amorphous alloy that itself has no grain boundaries and is very smooth. Suitable amorphous alloys include high-phosphorus electroless nickel or an amorphous electrolytic cobalt-tungsten-boron alloy described in U.S. Pat. No. 4,529,668, whose disclosure is incorporated herein.

The apparatus 30 further includes a metal injector 40 disposed to controllably force metal into the metal injection port 34 of the die-casting mold 32. The metal injector 40 comprises an injector tube 42 that contains the metal prior to injection, and a mechanism including a piston 44 fitted in the injector tube 42. The injector 40 further includes a driving mechanism 46 that controllably reciprocates the piston 44 within the injector tube 42. Optionally, an injector heater (or cooler) 47 is provided for the injector tube 42 to maintain a charge of metal therein at a desired temperature. The injector heater 47, when provided, is typically an electrical resistance heater or an induction heater.

A metal heater 48 is positioned adjacent to the injector tube 42. The metal heater 48 includes a heating cavity 50 that receives the charge of the metal to be injected into the mold 32. The heating cavity 50 is heated by a cavity heater 52, which is typically an electrical resistance heater or an induction heater. A controllable metal gate 54 separates the heater cavity 50 from the injector tube 42. When the metal charge in the heater cavity 50 is heated to a temperature sufficient for the die-casting operation and the metal injector 40 and die-casting mold 32 are ready for a die-casting operation, the metal gate 54 is opened to allow the charge of metal to move from the heating cavity 50 into the injector tube 42. Another charge of metal is then loaded into the heating cavity 50 to be heated.

Figure 3:
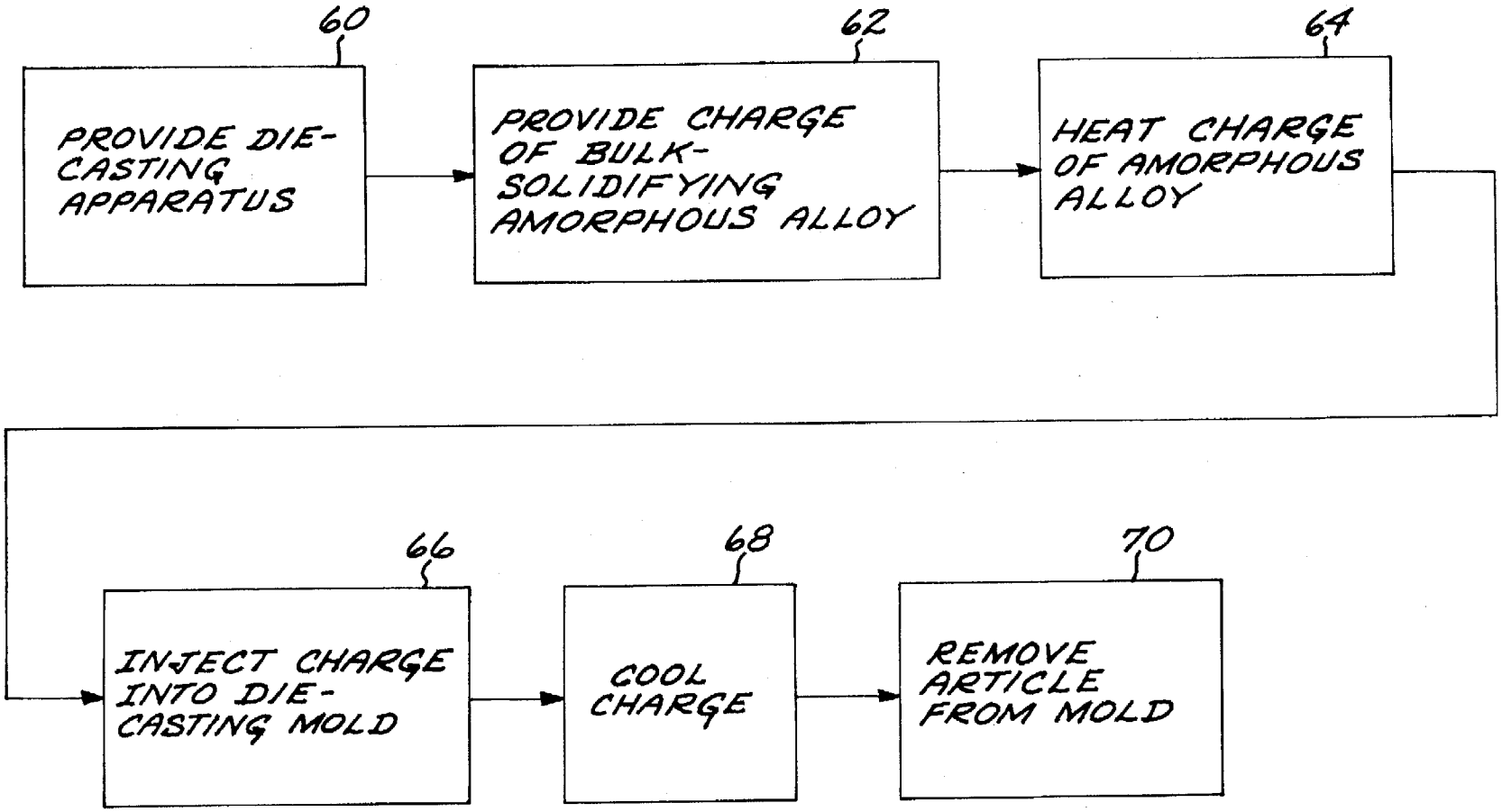
FIG. 3 is a block flow diagram of a method for using the apparatus of FIG. 2 to prepare the article of FIG. 1.

FIG. 3 depicts a method of fabricating the article 20. The die-casting apparatus is provided, numeral 60. The die-casting apparatus may be the apparatus 30 or any other suitable die-casting apparatus such as those described subsequently herein.

The charge of the bulk-solidifying amorphous alloy is provided, numeral 62. The amorphous alloy is a metal alloy that can be cooled from the melt to retain the amorphous form in the solid state, termed herein a "bulk solidifying amorphous metal". Such metals can be cooled from the melt at relatively low cooling rates, on the order of about 500° C. per second or less, yet retain an amorphous structure after cooling. These bulk-solidifying amorphous metals do not experience a liquid/solid crystallization transformation upon cooling, as with conventional metals. Instead, the highly fluid, non-crystalline form of the metal found at high temperatures becomes more viscous as the temperature is reduced, eventually taking on the outward physical properties of a conventional solid.

This ability to retain an amorphous structure even with a relatively slow cooling rate is to be contrasted with the behavior of other types of amorphous metals that require cooling rates of at least about $10^{4\circ}$–$10^{6\circ}$ C. per second from the melt to retain the amorphous structure upon cooling. Such metals can only be fabricated in amorphous form as thin ribbons or particles. Such a metal has limited usefulness because it cannot be prepared in the thicker sections required for typical articles of the type prepared by die casting.

Even though there is no liquid/solid crystallization transformation for a bulk-solidifying amorphous metal, a "melting temperature" $T_m$ may be defined as the temperature at which the viscosity of the metal falls below $10^2$ poise upon heating. It is convenient to have such a $T_m$ reference to describe a temperature above which the viscosity of the material is so low that, to the observer, it apparently behaves as a freely flowing liquid material.

Similarly, an effective "freezing temperature", $T_g$ (often referred to as the glass transition temperature), may be defined as the temperature below which the viscosity of the cooled liquid rises above $10^{13}$ poise. At temperatures below $T_g$, the material is for all practical purposes a solid. For the zirconium-titanium-nickel-copper-beryllium alloy of the preferred embodiment, $T_g$ is about 330°–400° C. and $T_m$ is about 660°–800° C.

The present invention relates to three classes of die casting operations wherein bulk-solidifying amorphous alloys are die cast with little or no porosity in the final product, an important advance because such die castings may be used where a degree of structural strength is desirable. These classes are overlapping to some extent.

In the first class, the linear coefficient of thermal expansion of the bulk-solidifying amorphous alloy is no greater than about $10\times10^{-6}$ per °C. when measured at a temperature below $T_g$, where $T_g$ is the temperature corresponding to a viscosity of the bulk-solidifying amorphous alloy of about $10^{13}$ poise. The coefficient of expansion, not normally viewed as an important consideration in die-casting alloys, is an important parameter when selecting bulk-solidifying amorphous alloys for die casting into closed molds, particularly when the die casting is to occur at higher temperatures. The linear coefficient of thermal expansion of bulk-solidifying amorphous alloys measured at temperatures above $T_g$ is typically about three times that of the same alloy measured at temperatures below $T_g$. When the bulk-solidifying amorphous alloy is die cast into a closed die, the portion of the die-cast alloy in contact with the walls of the die cools more rapidly than does the portion of the die-cast alloy along the centerline of the die-cast article, producing a shell of the lower-temperature bulk-solidifying amorphous alloy surrounding a core of the same material at a higher temperature. If the core is at a temperature above $T_g$, the coefficient of thermal expansion of the core is substantially higher than that of the shell. Porosity develops because the strain produced as a result of this differential thermal contraction of the alloy is greater than the local failure strain of the alloy, leading to a tensile failure.

The inventors have determined that the porosity within the die-cast bulk-solidifying amorphous alloy is avoided or is, at the most, acceptably small, if the linear coefficient of thermal expansion of the bulk-solidifying amorphous alloy is less than about $10\times10^{-6}$ per °C. when measured at a temperature below $T_g$. For bulk-solidifying amorphous alloys within this range, the internal stresses developed within the die-cast article are not so large that extensive internal fractures and porosity develop after die casting and during cooling. Such alloys can be die cast either in the range wherein the viscosity is less than about $10^2$ poise, or in the range wherein the viscosity is from about $10^2$ to about $10^{15}$ poise. If, however, the bulk-solidifying amorphous alloy has a linear coefficient of thermal expansion of substantially more than about $10\times10^{-6}$ per °C. at temperatures below about $T_g$, die casting at temperatures above $T_m$ without the presence of large amounts of porosity and/or voids cannot be accomplished.

At temperatures above $T_m$, the bulk-solidifying amorphous metal behaves like a freely flowing liquid metal during die casting. There is no discontinuous volume change upon heating or cooling through $T_m$. However, if the bulk-solidifying amorphous metal is die cast at temperatures at $T_m$ or above, the $\Delta T$ between the die casting temperature and ambient temperature is sufficiently large that sound, porosity-free articles are produced only if the coefficient of thermal expansion of the amorphous alloy is relatively low, no greater than about $10\times10^{-6}$ per °C. when measured at a temperature below $T_g$.

In the second class of operable die-casting processes for amorphous alloys, any bulk-solidifying amorphous alloy can be die cast if the die-casting temperature is below that corresponding to an alloy viscosity of about $10^2$ poise (i.e., below $T_m$). When the die casting is accomplished at such a relatively lower temperature, there is less total strain during die casting and cooling, leading to the shell/core morphology discussed previously. The development of porosity is inhibited by the relatively smaller total strain resulting from cooling from the lower temperature to ambient temperature, and the relatively higher strength of the amorphous alloy that resists the failure mode leading to the development of porosity.

At temperatures in the range between $T_m$ and $T_g$, the material behaves as a supercooled liquid during die casting. At temperatures between $T_m$ and $T_g$, the viscosity of the bulk-solidifying amorphous metal increases slowly and smoothly with decreasing temperature. Die casting at temperatures corresponding to a metal viscosity of from about $10^2$ ($T_m$) to about $10^8$ poise may be accomplished at high production rates for all known bulk-solidifying amorphous alloys. Die casting at temperatures corresponding to a metal viscosity of from about $10^8$ to about $10^{13}$ ($T_g$) poise may be performed for all known bulk-solidifying amorphous alloys. Die casting of amorphous alloys within this latter viscosity range is not suited for the production of articles at high production rates, but it may be used for relatively high value articles which need not be produced at high rates. That is, die casting in the temperature range corresponding to a metal viscosity of from about $10^8$ to about $10^{13}$ ($T_g$) poise is most usefully employed for articles wherein the use of the amorphous metal itself (rather than a high production rate) provides important advantages, and the articles themselves have such high value that a relatively slower production rate can be tolerated.

Die casting of amorphous metals in the temperature range below $T_m$ represents an advancement in die casting not possible with non-amorphous metals. Die casting has traditionally been possible only for metals at temperatures in the liquid state above their melting points. The present invention permits die casting at temperatures below $T_m$, an important advance because bulk-solidifying amorphous metals having both low and high coefficients of thermal expansion may be die cast as sound articles.

At temperatures below $T_g$, die casting of bulk-solidifying amorphous metals becomes progressively more difficult and, at the lower temperatures (higher viscosities), impossible. At temperatures below $T_g$, the bulk-solidifying amorphous metal behaves as a solid, exhibiting an amorphous, non-crystalline structure if cooled at the required cooling rate. Die casting at temperatures corresponding to a metal viscosity of from about $10^{13}$ ($T_g$) to about $10^{15}$ poise may be performed for all known bulk-solidifying amorphous alloys, but is so slow and requires such high die casting injection pressures as to be impractical for any applications known to the inventors. Die casting at temperatures corresponding to a metal viscosity of greater than about $10^{15}$ poise is not possible for any bulk-solidifying amorphous alloys known to the inventors, because of the excessive high flow stresses and excessively long die casting times associated with these temperatures.

In the third class of operable bulk-solidifying amorphous alloys, bulk-solidifying amorphous alloy having a titanium-plus-zirconium content of at least about 20 atomic percent of the alloy are die castable. Such alloys have a coefficient of thermal expansion of less than about $10\times10^{-6}$ per °C. A preferred type of bulk-solidifying amorphous alloy has a composition of about that of a deep eutectic composition. Such a deep eutectic composition has a relatively low melting point and a steep liquidus. The composition of the bulk-solidifying amorphous alloy should therefore preferably be selected such that the liquidus temperature of the amorphous alloy is no more than about 50°–75° C. higher than the eutectic temperature, so as not to lose the advantages of the low eutectic melting point and also so that the wear upon the die is not increased to an undesirably high level by the die casting operations. The liquidus temperature of the titanium+zirconium alloy should not be more than about 850° C. in any case for the die casting operation. The relatively low temperatures used in the die casting of bulk-solidifying amorphous alloys results in low wear to the die and the die casting apparatus.

It has been known to die cast some bulk-solidifying amorphous alloys, see, for example, A. Inoue et al., "Mg—Cu—Y Bulk Amorphous Alloys with High Tensile Strength Produced by a High-Pressure Die Casting Method", *Materials Transactions, JIM*, vol. 33, no. 10, pages 937–945 (1992). The die casting operation was accomplished at a relatively high temperature, but the resulting die-cast article was reported to exhibit about 17 percent porosity, a value far too high for use in commercial applications where moderate-to-high strength is required. Inoue et al. did not propose an approach for reducing or avoiding the porosity.

A most preferred type of bulk-solidifying amorphous alloy has a composition near a eutectic composition, such as a deep eutectic composition with a eutectic temperature on the order of 660° C. This material has a composition, in atom percent, of from about 45 to about 67 percent total of zirconium plus titanium, from about 10 to about 35 percent beryllium, and from about 10 to about 38 percent total of copper plus nickel. A substantial amount of hafnium can be substituted for some of the zirconium and titanium, aluminum can be substituted for the beryllium in an amount up to about half of the beryllium present, and up to a few percent of iron, chromium, molybdenum, or cobalt can be substituted for some of the copper and nickel. A most preferred such metal alloy material has a composition, in atomic percent, of about 41.2 percent zirconium, 13.8 percent titanium, 10 percent nickel, 12.5 percent copper, and 22.5 percent beryllium. This bulk-solidifying alloy is known and is described in U.S. Pat. No. 5,288,344. It has a liquidus temperature of about 720° C. and a tensile strength of about 1.9 GPa.

Another bulk-solidifying amorphous alloy material has a composition, in atom percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent. A most preferred metal alloy of this group has a composition, in atomic percent, of about 60 percent zirconium about 15 percent aluminum, and about 25 percent nickel. This alloy system is less preferred than that described in the preceding paragraph.

Bulk-solidifying amorphous alloys have important features when used in die casting. When the die casting parameters are selected in conjunction with the bulk-solidifying amorphous metals, the final product has acceptably low (or no) porosity, so that these features can be utilized to the greatest advantage. First, they are cooled at the cooling rates inherent in die casting such that the metal at the surface, at the centerline, and throughout the die-casting mold can be solidified at a rate sufficiently high that the final article is amorphous. Second, because the metal does not undergo a liquid/solid transformation upon cooling, there is no large, discontinuous volume change that is the principal cause of porosity and shrinkage cavities. (The properties such as viscosity and volume change continuously in the case of the bulk-solidifying amorphous metal, rather than discontinuously.) The metallurgical quality and soundness of the resulting articles is surprisingly and unexpectedly improved as compared with articles prepared from non-amorphous alloys. Third, the surface of the as-solidified bulk-solidifying amorphous alloy is of high quality and quite smooth, when solidified against a high-quality, smooth surface. Consequently, excellent surface quality can be achieved by making the internal molding surface 38 very smooth, such as in the manner discussed previously.

The fourth important advantage of using bulk-solidifying amorphous alloys for die casting lies in their low surface coefficient of friction, which alters the nature of the die-casting operation itself. In conventional die-casting operations, the internal molding surface 38 must be lubricated with a lubricant such as an oil, a silicone, or a graphite particulate between each die-casting operation. The need for lubrication increases the cost of the process through both the cost of the lubricant and the time and equipment required to accomplish the lubrication. When bulk-solidifying amorphous alloys are used in die casting, lubrication of the internal molding surface 38 is not required in most cases. The absence of the lubrication in the present approach results in a further improvement to the surface finish and soundness of the die-cast article, inasmuch as the chemical breakdown of the lubricant adversely affects surface finish. Additionally, the decomposition products of the lubricant may pose a workplace health hazard, and the present approach eliminates this problem.

Returning to the description of FIG. 3, the charge of the bulk-solidifying amorphous alloy is heated to a temperature such that it may be die cast in the die-casting apparatus, numeral 64. This temperature may be above $T_m$, but it is not necessarily above $T_m$ as long as the viscosity of the amorphous alloy is sufficiently low that it may be moved through the apparatus into the die-casting mold.

The charge of the bulk-solidifying amorphous alloy is transferred to the metal injector and thereafter injected into the die-casting mold, numeral 66. The pressure required to accomplish the injection is typically from about 500 to about 4000 pounds per square inch of working surface of the piston 44. This pressure varies according to the temperature of the amorphous alloy, and thence its viscosity. The injection pressures used with the present approach are lower in most cases than those used with the die casting of conventional metals (i.e., 4000–8000 pounds per square inch), because there is no need for an increase in pressure at the end of the injection cycle. Consequently, the die-casting mold and associated equipment are lighter and less expensive. Higher die casting pressures are required in the present approach, however, when the die casting is accomplished at lower temperatures.

The charge of amorphous alloy in the die-casting mold is cooled at a rate such that the amorphous alloy retains the amorphous state upon cooling, numeral 68. This cooling rate, which may be controlled and accelerated as required by the cooling of the die-casting mold, is preferably such that the cooling rate at the centerline of the die-casting cavity is less than about 500° C. per second but sufficiently high to retain the amorphous state in the bulk-solidifying amorphous alloy. Higher cooling rates are not required for the bulk-solidifying amorphous alloy to remain amorphous upon cooling, and in fact are not preferred because they may lead to cold shuts in the die castings. That is, the lowest cooling rate that will achieve the desired amorphous structure in the article is chosen and achieved using the design of the die-casting mold and the cooling channels. The value of this cooling rate cannot here be specified as a fixed numerical value, because that value varies for different metal compositions, die shapes and materials, and the shape and thickness of the article being die cast. However, the value can be determined for each case using conventional heat flow calculation procedures.

After the article has cooled within the die-casting mold to a temperature below which it could transform to the crystalline state, it is removed from the mold, numeral 70. The process of steps 62, 64, 66, 68, and 70 is then repeated if another article of the same type is to be die cast.

Conventional metals cannot be die cast at temperatures below their melting points. The use of a bulk-solidifying amorphous material for die casting permits the operation to be conducted for metal temperatures both above and below $T_m$, and the selection between these approaches can be made responsive to specific requirements. Die casting of the bulk-solidifying amorphous metal above $T_m$ (i.e., viscosity below about $10^2$ poise) is used for the most intricate die castings, because the low viscosity of the metal allows it to flow into small recesses and the like with relatively small injection pressures. Die casting at or slightly below $T_m$ increases the speed of the die casting operation because less heat must be removed from the metal, reduces die wear, reduces risk to personnel due to the presence of a highly fluid metal, permits the use of inexpensive atmospheres such as nitrogen or even air, and offers some manufacturing advantages such as ease of handling and measuring the solid metal. However, higher die-casting injection pressures are required. With further decreases of the die-casting temperature below $T_m$, the speed of the die casting operation is reduced because of the slower strain rates that can be achieved. Both types of processing are generally within the scope of the processing of FIG. 3, and the apparatus is generally within the scope of the apparatus of FIG. 2, in each case. There may be, however, further operations and features that are specific to each approach.

Figure 4:
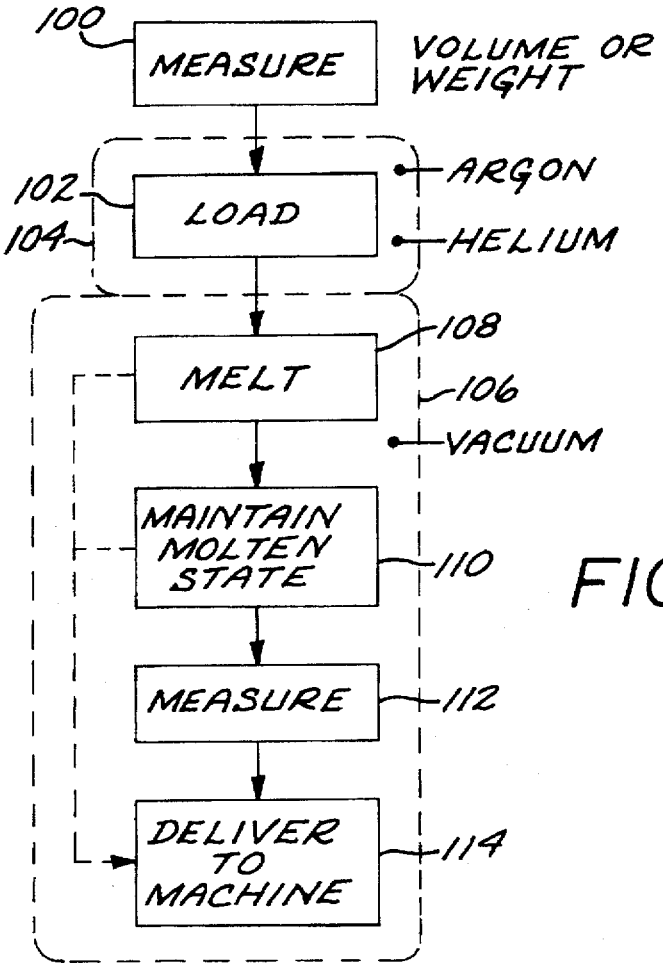
FIG. 4 is a block flow diagram of a portion of a method for die casting at a temperature above $T_m$.
Figure 5:
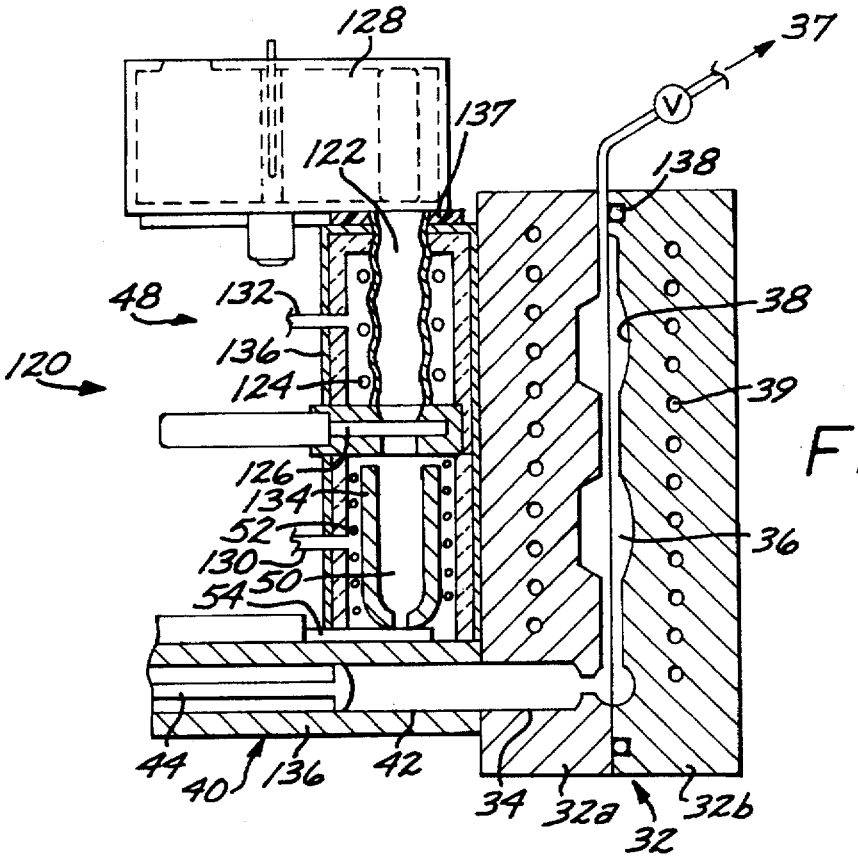
FIG. 5 is a schematic sectional view of an apparatus particularly adapted for die casting of bulk-solidifying amorphous alloys at a temperature above $T_m$.

FIG. 4 is a process block flow diagram for one approach for die casting conducted with the metal temperature above $T_m$, and FIG. 5 depicts an apparatus particularly suited for such processing. An ingot of the desired composition is weighed or established by the volume of the ingot, and the total amount of the metal to be prepared, numeral 100. The ingot is loaded, numeral 102, into a controlled atmosphere chamber, numeral 104, which is typically filled with an inert gas such as argon or helium. The ingot is thereafter transferred to a vacuum chamber 106. There it is melted (i.e., heated to a temperature well above $T_m$), numeral 108. The ingot is brought to the proper temperature for the die casting operation, numeral 110, in this case a temperature above $T_m$. The proper amount of metal to form the charge is measured, numeral 112. If the amount of metal prepared in step 100 was exactly the required amount for one die-casting shot, then the step 112 is omitted. If the amount of metal prepared in step 100 was sufficient for multiple shots, the step 112 is used to measure the correct amount for one charge. The properly sized charge is delivered to the injector for injection into the die-casting mold, numeral 114.

That the metal is above $T_m$, at a temperature where it flows in a fluid, low-viscosity manner, permits it to be handled as a standard liquid metal. It can be processed in quantifies greater than the size of the die-casting charge or in the size of the die-casting charge. Die-casting injection pressures are relatively low. However, this processing approach requires a die-casting apparatus that is capable of operations at relatively higher temperatures than the subsequently described warm casting approach.

FIG. 5 illustrates an apparatus 120 that is useful in conjunction with the processing approaches of FIGS. 3 and 4, for large-scale production operations. Many of the elements are common with those of the apparatus 30 of FIG. 2 and have been assigned the same numerical identifiers. The earlier discussion of these elements is incorporated herein. The apparatus 120 includes a preheating cavity 122 having a preheater 124. A preheating gate 126 holds the charge in the preheating cavity 122 until it is required in the heating cavity 50. The preheating metal gate 126 then opens and permits the charge to fall into the heating cavity 50. At a later time, the metal gate 54 opens and permits the charge to fall into the injector tube 42. The heating cavity 50 may be just large enough for a single charge of metal, or larger in volume than a single charge of metal. In the former case, the metal gate 54 remains open for a time such that the entire volume of metal in the heating cavity 50 flows into the injector tube 42. In the latter case, the heating metal gate 54 remains open only for a time sufficient that a volume of metal equal to a single charge of metal can fall into the injector tube 42, and then closes.

In the preferred form of this approach, the charge is supplied to the preheating cavity 122 by a controllable carousel dispenser 128, which dispenses one charge at a time into the preheating cavity 122. Vents 130 and 132 permit the heating cavity 50 and the preheating cavity 122, respectively, to be provided with a controlled atmosphere or evacuated, depending upon the requirements of a particular process.

At the relatively high temperatures of this version of the process, care is taken to exclude oxygen from the metal both before and after injection into the die, thereby reducing the incidence of oxides in the final die-cast article 20. An air-tight seal 136 of a material such as a high-temperature rubber or a silicone is provided around the metal heater 48 and around the metal injector 40. An air-tight seal 137 of a high-temperature rubber or a silicone is also provided between the metal heater 48 and the carousel dispenser 128. Any oxygen reaching the interior of the metal heater is evacuated through the vent 132, which in this case is connected to a vacuum line and then backfilled with an inert gas during the period that the metal resides within the preheating cavity. The vent 130 is used similarly to evacuate oxygen from the heating cavity 50 to reduce oxidation of the metal while it is in the heating cavity 50. Oxidation of the metal as it is heated to the die-casting temperature above $T_m$ is thereby minimized. Additionally, the die-casting cavity 36 is evacuated by the vacuum pump 37. A seal, such as an O-ring seal 138, minimizes any back leakage of oxygen into the die-casting cavity 36 through the joint between the mold segments 32*a* and 32*b*.

The apparatus 120 is operated in the following multistage, semi-continuous manner. A solid charge of metal is delivered from the carousel dispenser 128 to the preheating cavity 122. In the preheating cavity 122, the charge is heated to a temperature at which it is close to $T_m$, but sufficiently below $T_m$ such that the charge is retained in its solid form. Oxygen is removed from the preheating cavity 122 by pumping through the vent 132, so that the preheating cavity operates as both a heater and an air lock. Upon operation of the preheating gate 126, the charge falls into the heating cavity 50, where it is heated to a temperature above $T_m$ so that it flows in a fluid manner. The heating cavity 50 therefore must accommodate the fluid metal, and typically includes a crucible 134 made of a refractory material. Upon operation of the metal gate 54, the metal flows into the injector tube 47 and is subsequently injected into the die-casting mold 32. The advance of the charge along this path occurs in a coordinated fashion. That is, any particular charge moves forward into the next region 122, 50, 42, and 32, and is eventually ejected from the mold 32, in a stepwise fashion at the same time the preceding charge moves from that region into its next region. The stepwise heating of the charge is desirable so that a charge need not be heated directly from ambient temperature to the die-casting temperature in a single step, to permit the removal of oxygen from around the charge as it is heated.

In another variation of the basic approach of FIGS. 2 and 3, the metal charge may be die cast at a temperature below $T_m$, at a viscosity higher than about $10^2$ poise. The lower the temperature, the higher the viscosity and the higher the pressure required on the piston 44. While larger forces are therefore required, placing higher loads on the machinery, this approach may be desirable in certain production operations. The temperatures involved are generally not as high as those encountered in the apparatus 120, and there is no requirement for handling fluid metal. This approach is therefore particularly useful for the manufacture of relatively small, non-complex parts at manufacturing sites where personnel and equipment are not available for handling fluid metals. The lower temperature limit of the die casting operation is established by the increasing viscosity with decreasing temperature below $T_g$. The lower temperature limit is about 30°–60° C. below $T_g$, at which temperature (and below) the viscosity is above about $10^{15}$ poise.

Figure 6:
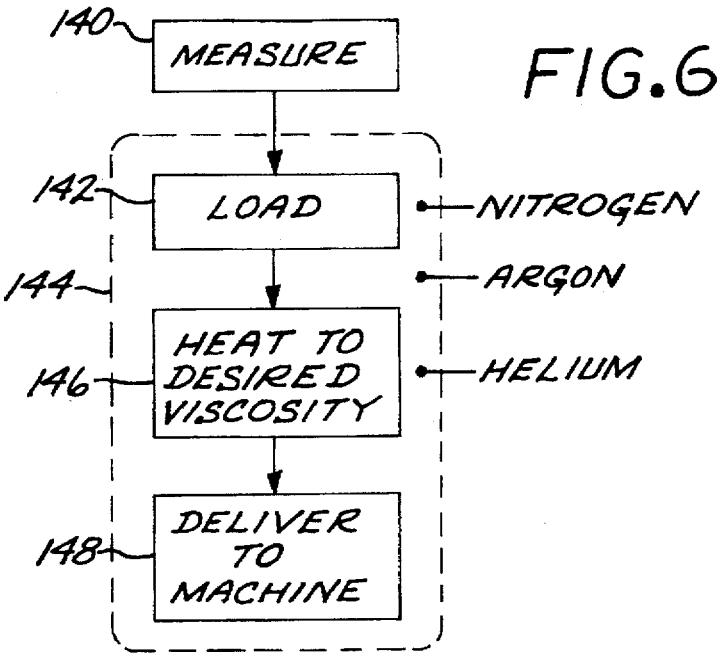
FIG. 6 is a block flow diagram of a portion of a method for die casting at a temperature below $T_m$.

In this variation of the process as illustrated in FIG. 6, a single charge of metal is measured, numeral 140, and loaded into a chamber 142 that has a controlled atmosphere such as nitrogen, argon, or helium, or a vacuum, numeral 144. The "single charge" is sufficient for filling the die-casting cavity 36 a single time. However, this single charge may be in the form of a single piece or ingot of the metal, or in the form of a plurality of small pieces or pellets. The charge is heated to the desired temperature (below $T_m$) at which it has a desired viscosity, numeral 146, and thereafter delivered to the metal injector, numeral 148.

Figure 7:
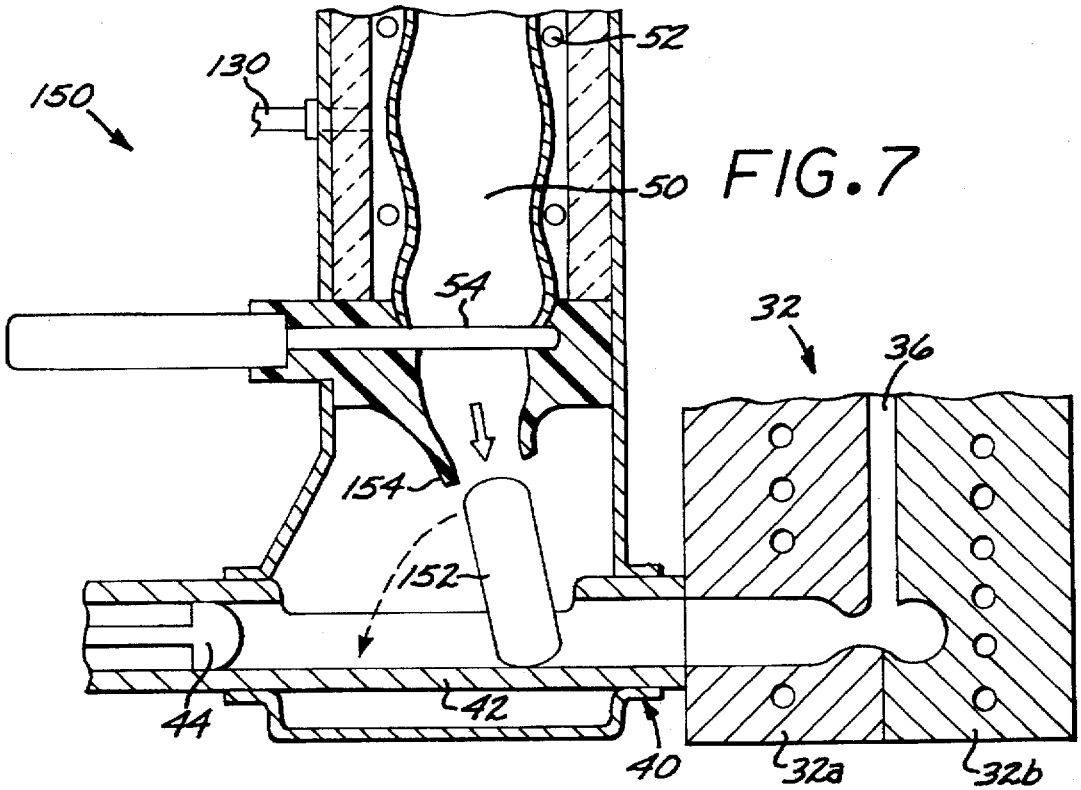
FIG. 7 is a schematic fragmentary sectional view of an apparatus particularly adapted for die casting of bulk-solidifying amorphous alloys at a temperature below $T_m$.

FIG. 7 illustrates a portion of an apparatus 150 that is useful in conjunction with the processing approaches of FIGS. 3 and 6, for large-scale production operations. (Those portions of the apparatus not shown in FIG. 7 are as shown either in FIGS. 2 or 5, or other operable form.) Of the elements shown in FIG. 6, many are common with those of the apparatus 30 of FIG. 2 and have been assigned the same numerical identifiers. The earlier discussion of these elements is incorporated herein. It will be recalled that, in the processing depicted in FIG. 6, the charge remains at a viscosity such that it is, for practical purposes, a solid metal but with a significantly lower flow stress than for the solid metal at ambient temperature. It can therefore be handled as pieces, pellets, or a solid metal ingot 152, shown in FIG. 7, but also may be die cast. Handling pieces of solid metal is mechanically easier than handling fluid metal in such a processing operation, and also does not require materials of construction in the apparatus 150 that can withstand fluid metals. Thus, in this approach, the heating cavity 50 heats the charge to a temperature at which it still can be handled as a solid. The metal gate 54 releases the solid ingot 152 into the injector tube, and a chute 154 guides the solid ingot 152 so that it falls into the injector tube 42 in the proper aligned orientation. The remaining aspects of the apparatus 150 and its utilization are as described previously.

In another embodiment, the approach of the invention can be used to die cast individual articles directly from elongated rods or billets of the bulk-solidifying amorphous alloy, without the bulk-solidifying amorphous alloy being heated above $T_m$ during die casting. This embodiment has the important advantage that the bulk-solidifying amorphous alloy is supplied to the die casting facility in large, easy-to-handle billets that do not require expensive processing prior to die casting. An apparatus 160 for accomplishing such die casting is illustrated in FIG. 8. A billet 162 of the bulk-solidifying amorphous alloy is supported in a billet holder 164, here illustrated as horizontal but which could be vertical. A forward end 166 of the billet 162 is inserted into a heating chamber 168, which is supplied with a purge gas through a purge gas line 170, water cooling through cooling lines 172, and induction power through induction lines 174 for a billet heater. The heating chamber 168 is continuous with a split die 176, of the type discussed previously. A reciprocating drive 178 engages a rearward end 180 of the billet 162 with a clamp 182 or other type of positively engaging device, so that the billet can be driven forwardly and rearwardly on the billet holder 164 by the action of the drive 178.

FIG. 9 illustrates the interior of the heating chamber 168 and its relation to the die 176. The billet 162 is moved in the forward direction so that its forward end 166 enters an induction coil 184 powered by the energy supplied through the induction lines 174. Purge gas, for example an inert gas such as argon, is supplied by the purge gas line 170 and forced into a purge-gas region 186 between the billet 162 and the walls of the heating chamber 168. A sliding seal 188 between the billet 162 and the walls of the heating chamber 168 allows the billet 162 to be moved toward and away from the die, while maintaining the positive pressure of the purge gas in the region 186 so that oxygen cannot leak into the interior of the die 176. A cooling block 190 cooled by the water supplied through the lines 172 thermally isolates the seal 188 and region 186 from the hotter temperatures produced by the induction coil 184. The portion of the billet 162 heated to a temperature below $T_m$ by the induction coil 184 is pushed forwardly by the motion of the entire billet and into a die cavity 192 within the die 176. The metal within the die is severed from the remainder of the billet 162 by shears 194. After the most forward end of the billet 162 (that lies within the die 176) is thus severed, the remaining portion of the billet is pulled back to lie within the induction coil 184 for reheating, prior to the next cycle of insertion of the heated portion into the die.

FIG. 10 depicts another approach for severing the portion of the billet inserted into the die from the remainder of the billet. In this case, a constriction 196 is positioned in the metal flow channel through which the billet 162 passes as it enters the die 176 and the die cavity 192. After the forward-most end of the billet has been inserted into and filled the die cavity, the reciprocating drive 178 draws the billet away from the die. The amorphous metal in the constriction experiences the greatest load and fails, severing the material of the billet from that in the die cavity. The ejection pins (not shown) of the stationary portion of the die may also aid in the severing of the metal as they operate to eject the article from the die. The same severing is achieved as in the FIG. 9 embodiment, but without the need for mechanical shears.

The approach of FIGS. 8–10 is particularly economically advantageous, inasmuch as die casting is accomplished using a long, semi-continuous piece of feedstock billet, and without the presence of any molten metal. Avoiding molten metal is particularly desirable for small die casting operations, because the molten metal is difficult and dangerous to handle without specialized, expensive equipment. The present approach requires no molten-metal handling equipment or safety precautions.

The present invention has been reduced to practice with the die casting of articles made of the most preferred bulk-solidifying amorphous alloy having a composition, in atomic percent, of about 41.2 percent zirconium, 13.8 percent titanium, 10 percent nickel, 12.5 percent copper, and 22.5 percent beryllium. Charges of the alloy were die cast into a tool steel die. The bulk-solidifying amorphous alloy was injected at 750° C. or 800° C. Successful trials were conducted with and without die lubrication.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing solid die-cast articles, comprising the steps of:

providing a die-casting apparatus including a die-casting mold having a metal injection port leading to a die mold cavity with an internal molding surface, a metal injector disposed to force metal into the injection port, and a metal heater operable to heat a charge of metal and provide the heated charge to the metal injector;

providing a charge of a bulk-solidifying amorphous alloy of sufficient volume to fill the die-casting mold cavity, the bulk-solidifying amorphous alloy having a linear coefficient of expansion of no greater than about $10\times10^{-6}$ per °C. when measured at a temperature below $T_g$, where $T_g$ is the temperature corresponding to a viscosity of the bulk-solidifying amorphous alloy of about $10^{13}$ poise;

heating the charge of the bulk-solidifying amorphous alloy to an injection temperature whereat its viscosity is less than about $10^2$ poise at the injection temperature using the metal heater;

injecting the charge of heated bulk-solidifying amorphous alloy into the die-casting mold using the metal injector; and cooling the charge in the die-casting mold at a cooling rate such that the charge remains amorphous in structure.

2. The method of claim 1, wherein the step of providing a charge includes a step of furnishing a charge having a composition comprising, in atom percent, from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

3. The method of claim 1, wherein the step of providing a charge includes a step of furnishing a charge having a composition with a titanium+zirconium content of at least about 20 atomic percent of the alloy.

4. The method of claim 1, wherein the step of providing a die-casting apparatus includes the step of providing an unlubricated die-casting mold.

5. The method of claim 1, wherein the step of providing a die-casting apparatus includes the step of providing a die-casting mold having the internal molding surface polished to a surface roughness of less than about 3 microinches RMS.

6. The method of claim 1, wherein the step of providing a die-casting apparatus includes the step of coating the internal molding surface of the die-casting mold with an amorphous metallic layer.

7. The method of claim 1, wherein the step of providing a die-casting apparatus includes the step of providing a metal heater having a first heating zone wherein the charge is heated to a temperature such that its viscosity is more than about $10^2$ poise and a second heating zone wherein the charge is heated to a temperature such that its viscosity is less than about $10^2$ poise.

8. The method of claim 1, wherein the step of cooling includes the step of cooling the charge at a centerline cooling rate of no greater than about 500° C. per second.

9. The method of claim 1, wherein the step of providing a charge includes a step of furnishing a charge having a composition with a titanium+zirconium content of at least about 20 atomic percent of the alloy.

10. A method for preparing solid die-cast articles, comprising the steps of:

providing a charge of a bulk-solidifying amorphous alloy of sufficient volume to fill the die-casting mold cavity, the bulk-solidifying amorphous alloy having a linear coefficient of expansion of no greater than about $10\times10^{-6}$ per °C. when measured at a temperature below $T_g$, where $T_g$ is the temperature corresponding to a viscosity of the bulk-solidifying amorphous alloy of about $10^{13}$ poise;

heating the charge of the bulk-solidifying amorphous alloy to an injection temperature whereat its viscosity is less than about $10^2$ poise;

injecting the charge of heated bulk-solidifying amorphous alloy into a die-casting mold under pressure; and cooling the charge in the die-casting mold at a cooling rate such that the charge remains amorphous in structure.

11. A method for preparing solid die-cast articles, comprising the steps of:

providing a charge of a bulk-solidifying amorphous alloy, the bulk-solidifying amorphous alloy having a linear coefficient of expansion of no greater than about $10\times10^{-6}$ per °C. when measured at a temperature below a glass transition temperature of the bulk-solidifying amorphous alloy;

heating the charge of the bulk-solidifying amorphous alloy to an injection temperature whereat its viscosity is less than about $10^2$ poise;

injecting the charge of heated bulk-solidifying amorphous alloy at the injection temperature into a die-casting mold under pressure; and cooling the charge in the die-casting mold at a cooling rate such that the charge remains amorphous in structure.

12. The method of claim 11, wherein the step of providing a charge includes a step of furnishing a charge having a composition comprising, in atom percent, from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

13. The method of claim 11, wherein the step of injecting includes the step of providing a die-casting apparatus including the die-casting mold having a metal injection port leading to a die mold cavity with an internal molding surface, a metal injector disposed to force metal into the injection port, and a metal heater operable to heat a charge of metal and provide the heated charge to the metal injector.

14. The method of claim 13, wherein the step of providing a die-casting apparatus includes the step of providing an unlubricated die-casting mold.

15. The method of claim 13, wherein the step of providing a die-casting apparatus includes the step of providing a die-casting mold having the internal molding surface polished to a surface roughness of less than about 3 microinches RMS.

16. The method of claim 13, wherein the step of providing a die-casting apparatus includes the step of coating the internal molding surface of the die-casting mold with an amorphous metallic layer.

* * * * *